US008022803B2

(12) United States Patent
Park et al.

(10) Patent No.: US 8,022,803 B2
(45) Date of Patent: Sep. 20, 2011

(54) TRANSFORMER

(75) Inventors: Geun Young Park, Suwon-si (KR); Soon Young Kwon, Suwon-si (KR); Deuk Hoon Kim, Incheon-si (KR); Duck Jin An, Ansan-si (KR); Sang Joon Seo, Suwon-si (KR); Myeong Sik Cheon, Suwon-si (KR)

(73) Assignee: Samsung Electro-Mechanics Co., Ltd., Gyunngi-do (KR)

( * ) Notice: Subject to any disclaimer, the term of this patent is extended or adjusted under 35 U.S.C. 154(b) by 6 days.

(21) Appl. No.: 12/430,376

(22) Filed: Apr. 27, 2009

(65) Prior Publication Data

US 2010/0214049 A1 Aug. 26, 2010

(30) Foreign Application Priority Data

Feb. 26, 2009 (KR) ..... 10-2009-0016200

(51) Int. Cl.

| | |
|---|---|
| ***H01F 27/30*** | (2006.01) |
| ***H01F 21/06*** | (2006.01) |
| ***H01F 21/02*** | (2006.01) |
| ***H01F 27/28*** | (2006.01) |

(52) U.S. Cl. ..... 336/208; 336/136; 336/145; 336/170; 336/196; 336/198

(58) Field of Classification Search ..... 336/136, 336/131, 145, 170, 196, 198, 208
See application file for complete search history.

(56) References Cited

U.S. PATENT DOCUMENTS

| | | | | |
|---|---|---|---|---|
| 4,916,424 | A * | 4/1990 | Kijima | 336/160 |
| 5,831,505 | A * | 11/1998 | Yamaguchi et al. | 336/83 |
| 7,199,649 | B2 * | 4/2007 | Noguchi | 327/544 |
| 7,274,282 | B2 * | 9/2007 | Park et al. | 336/192 |

FOREIGN PATENT DOCUMENTS

KR 10-2003-0034904 A 5/2003

* cited by examiner

*Primary Examiner* — Anh T Mai
*Assistant Examiner* — Ronald W Hinson
(74) *Attorney, Agent, or Firm* — Lowe, Hauptman, Ham & Berner, LLP

(57) ABSTRACT

The present invention provides a transformer capable of driving a plurality of lamps with one transformer by increasing the number of outer bobbins wrapping an outer circumferential surface of an inner bobbin wound by a coil and the number of output terminals by winding other coils around the outer bobbins.

2 Claims, 10 Drawing Sheets

[FIG. 1]
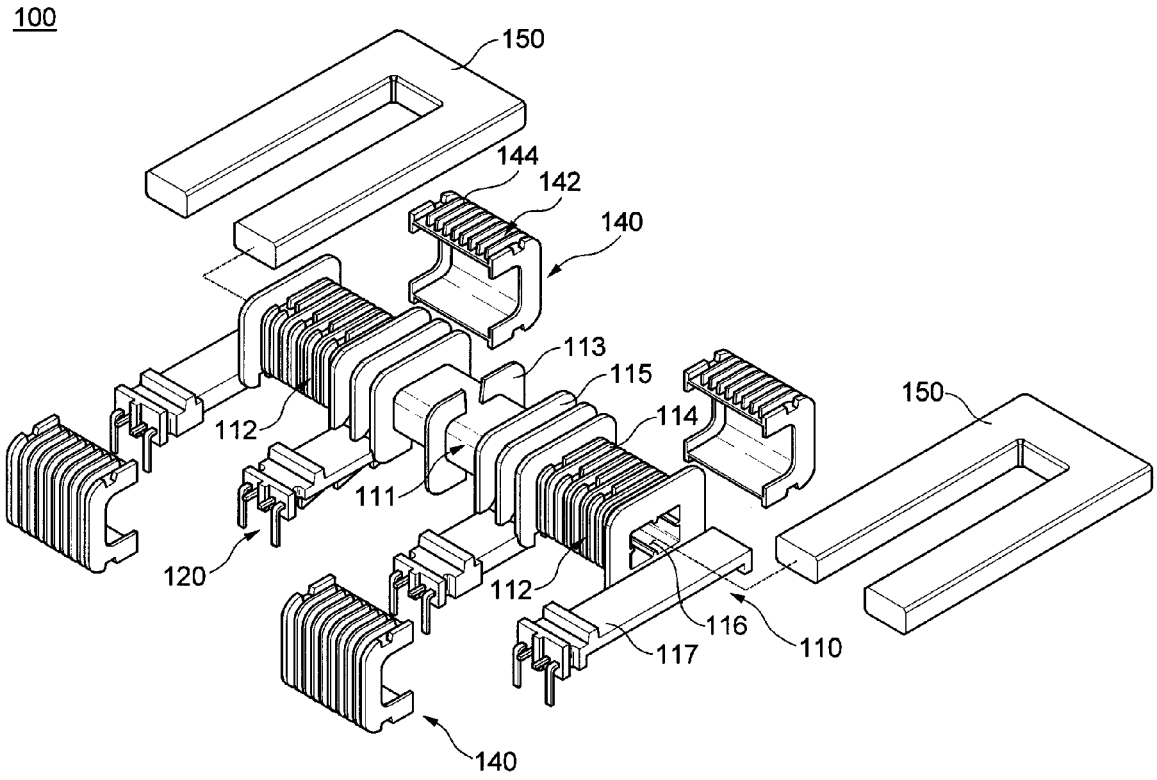

[FIG. 2]
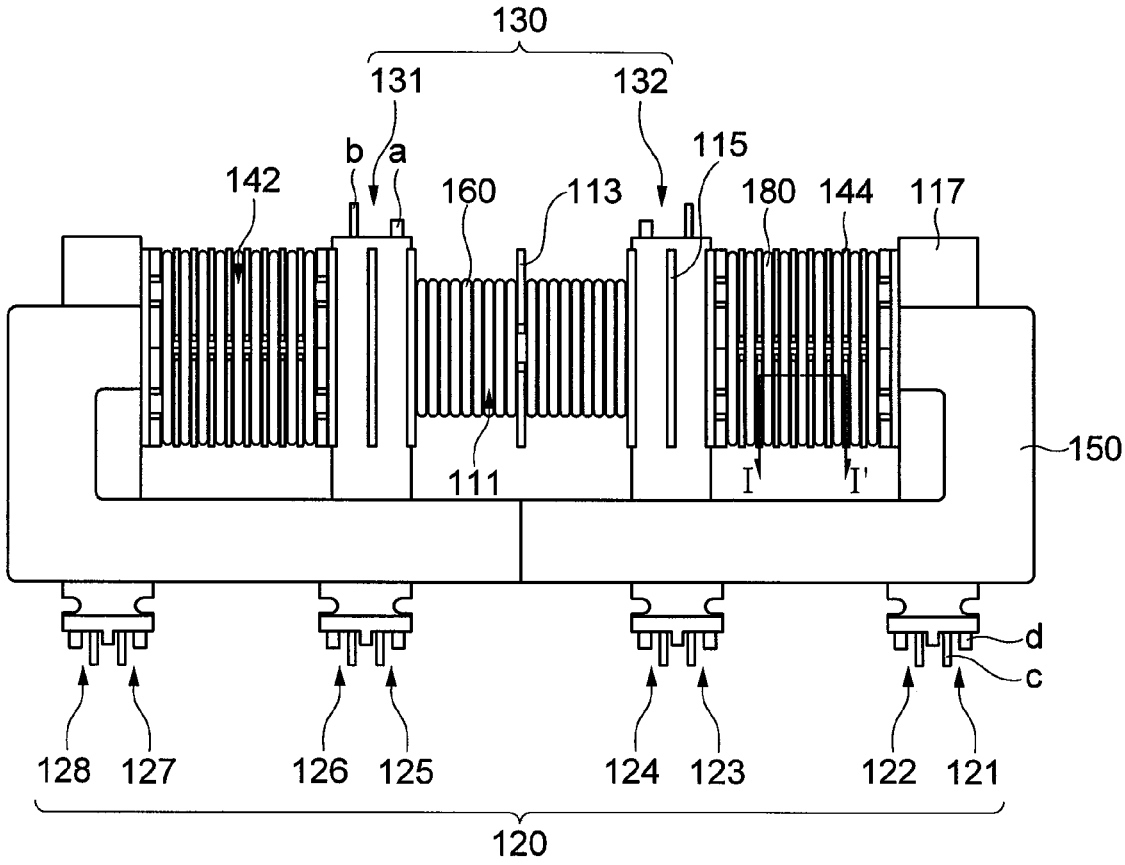

[FIG. 3]
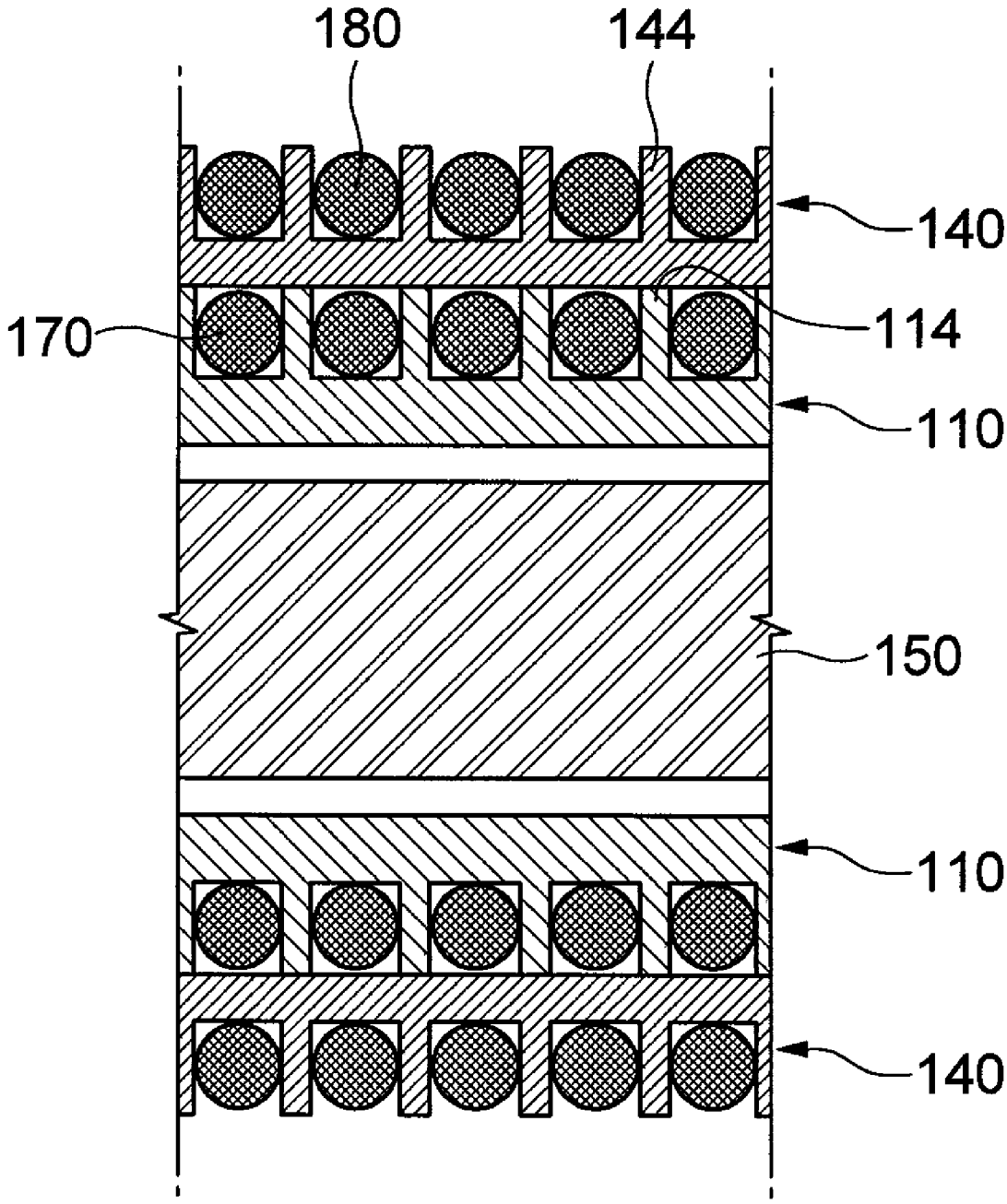

[FIG. 4]
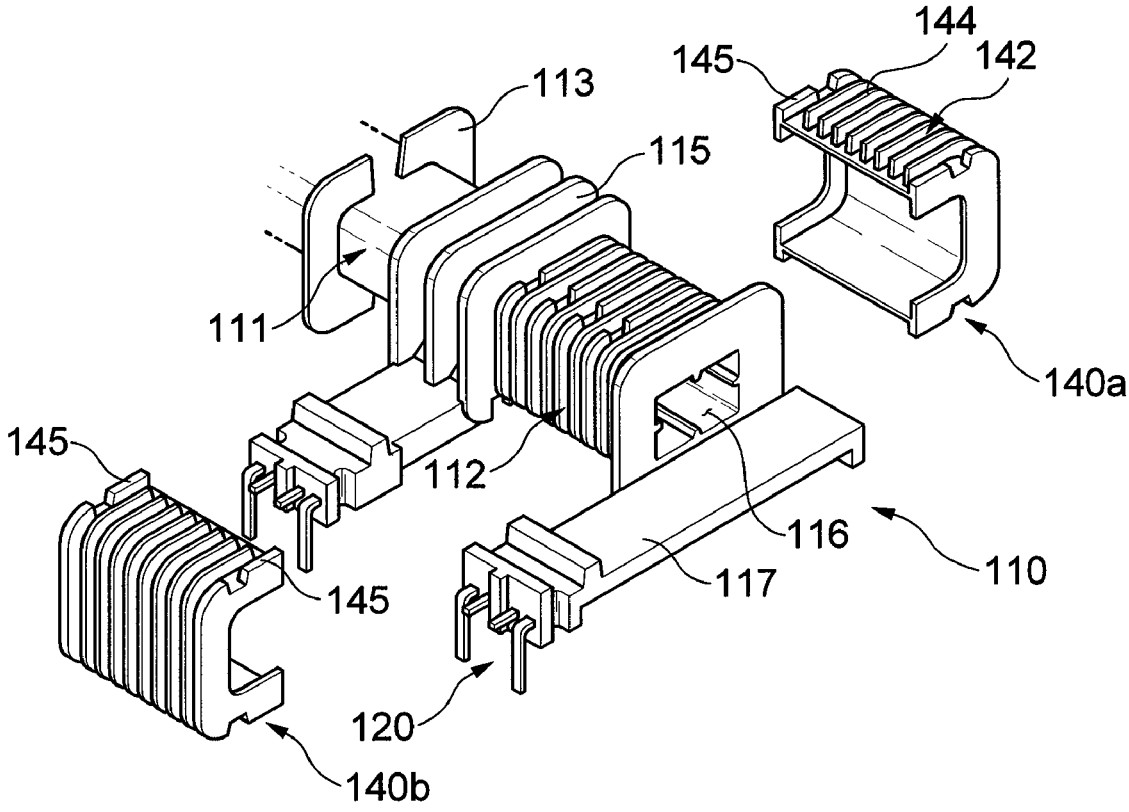

[FIG. 5]
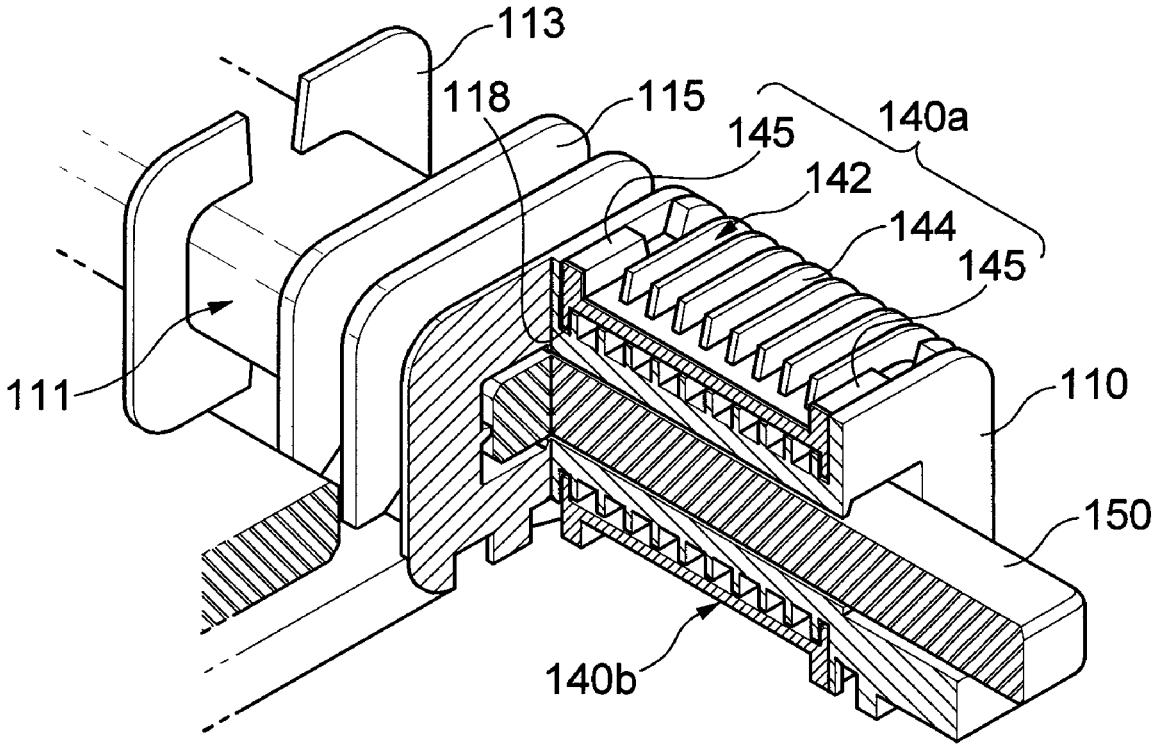

[FIG. 6]
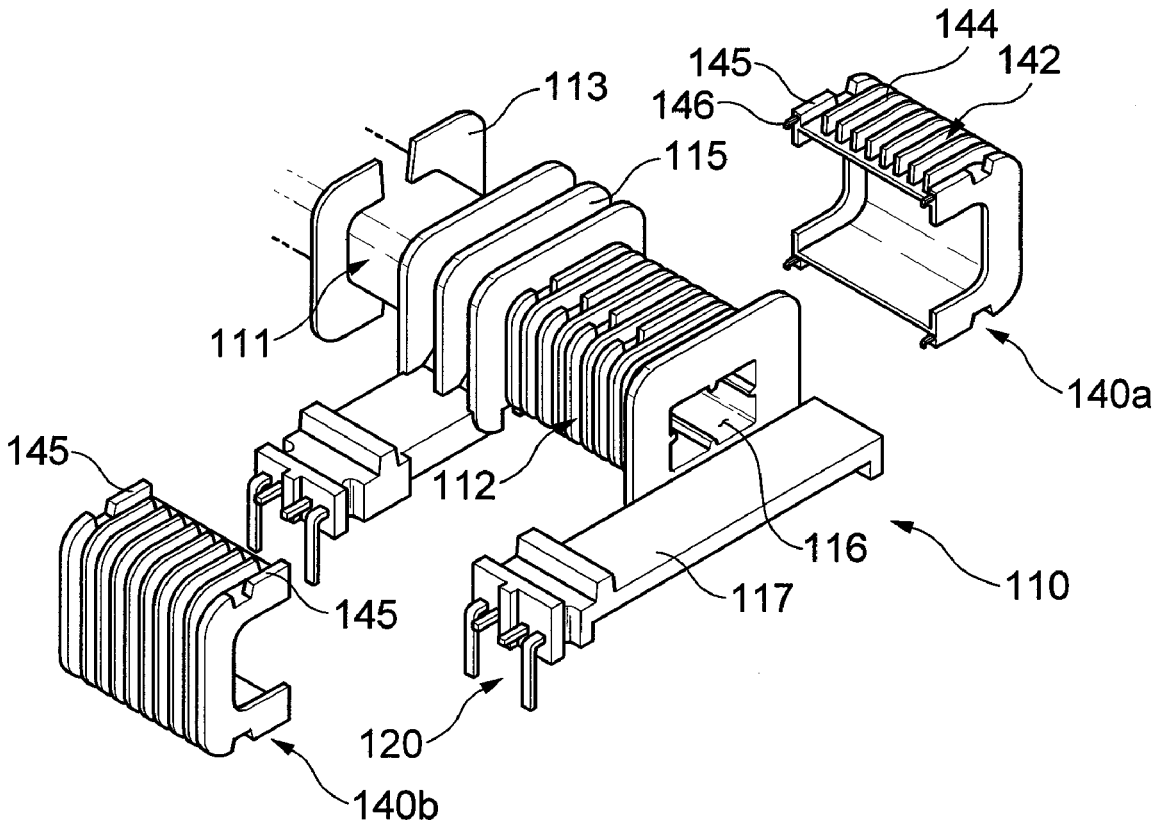

[FIG. 7]
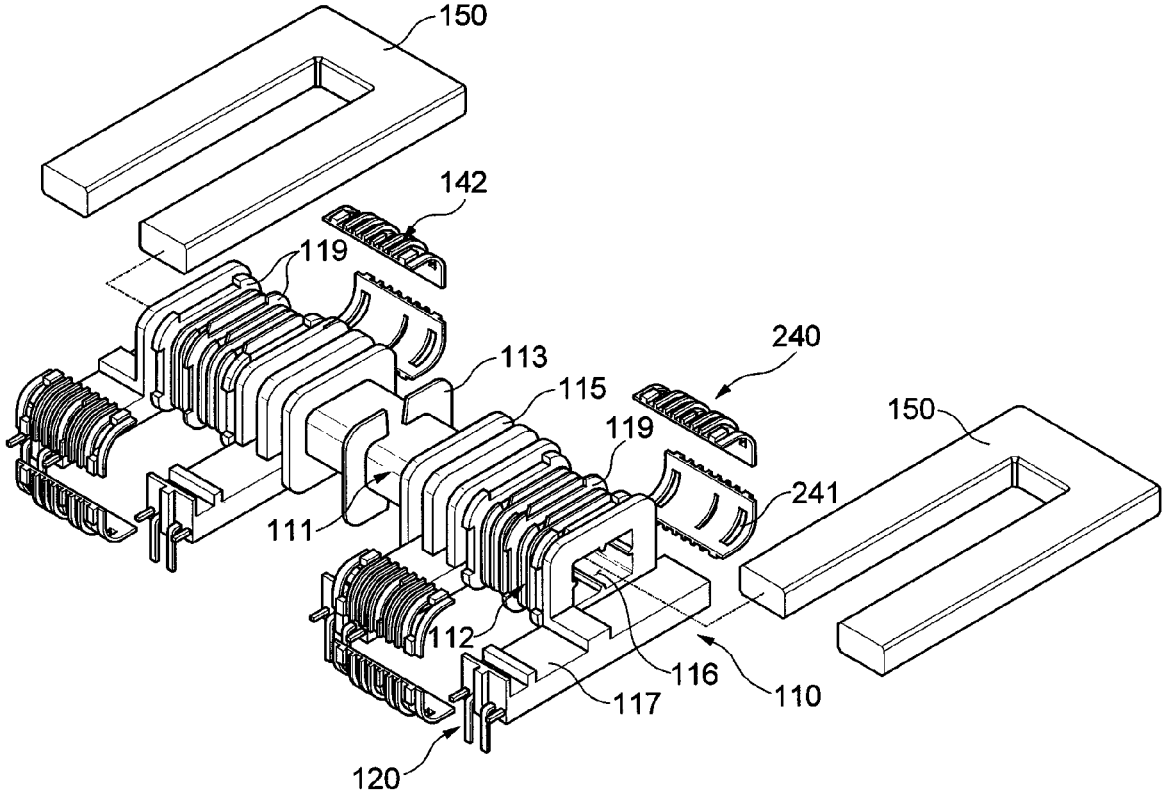

[FIG. 8]
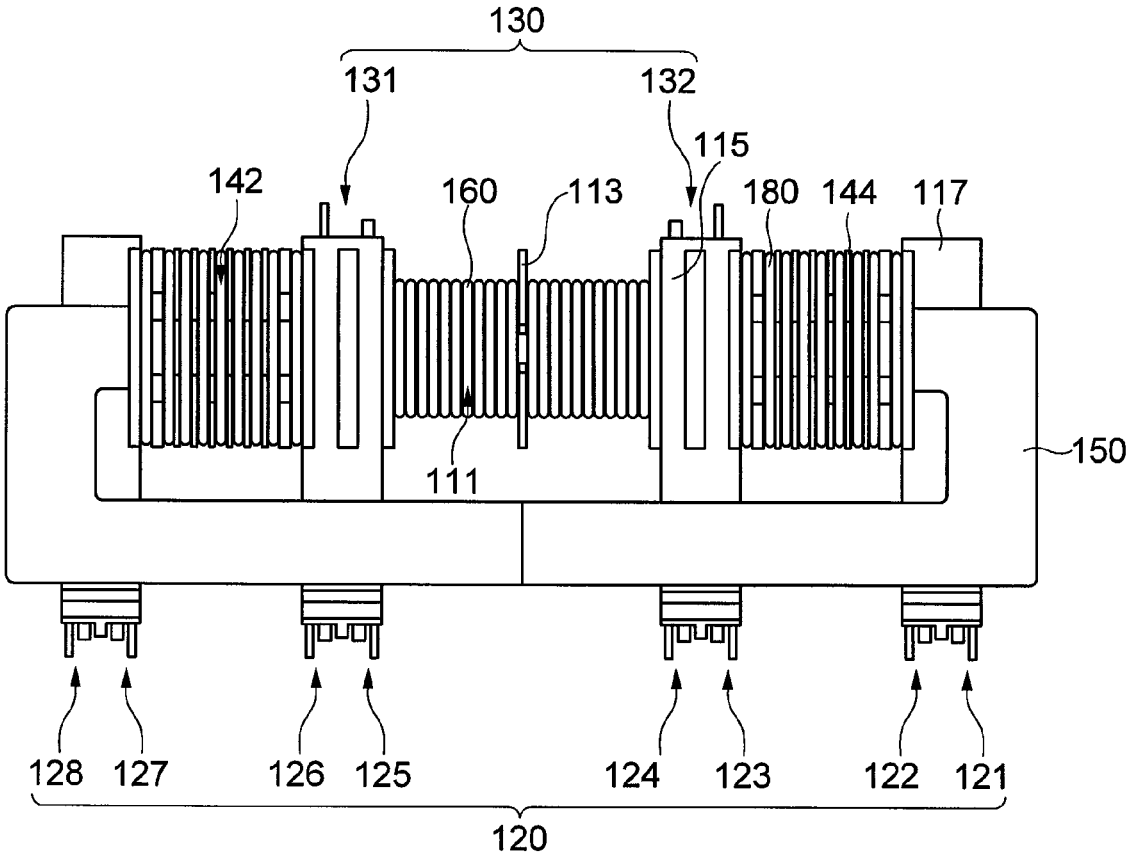

[FIG. 9]
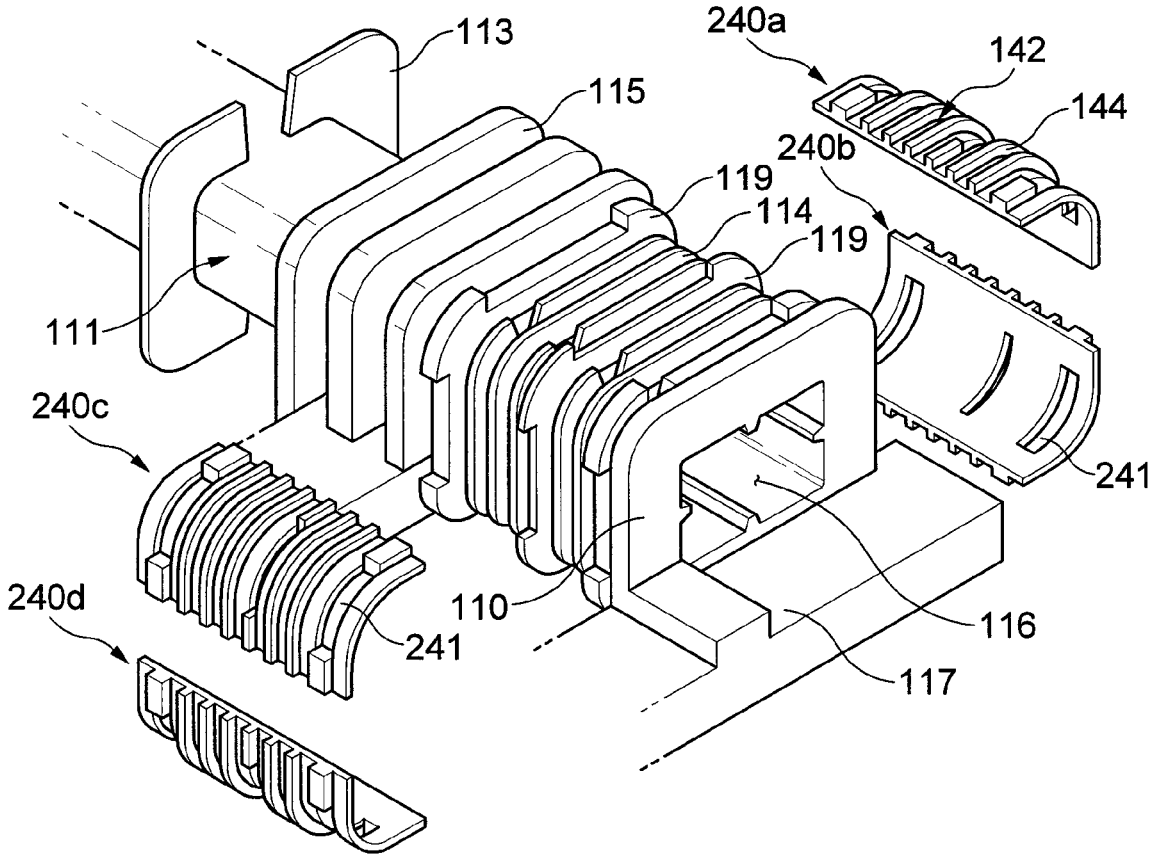

[FIG. 10]
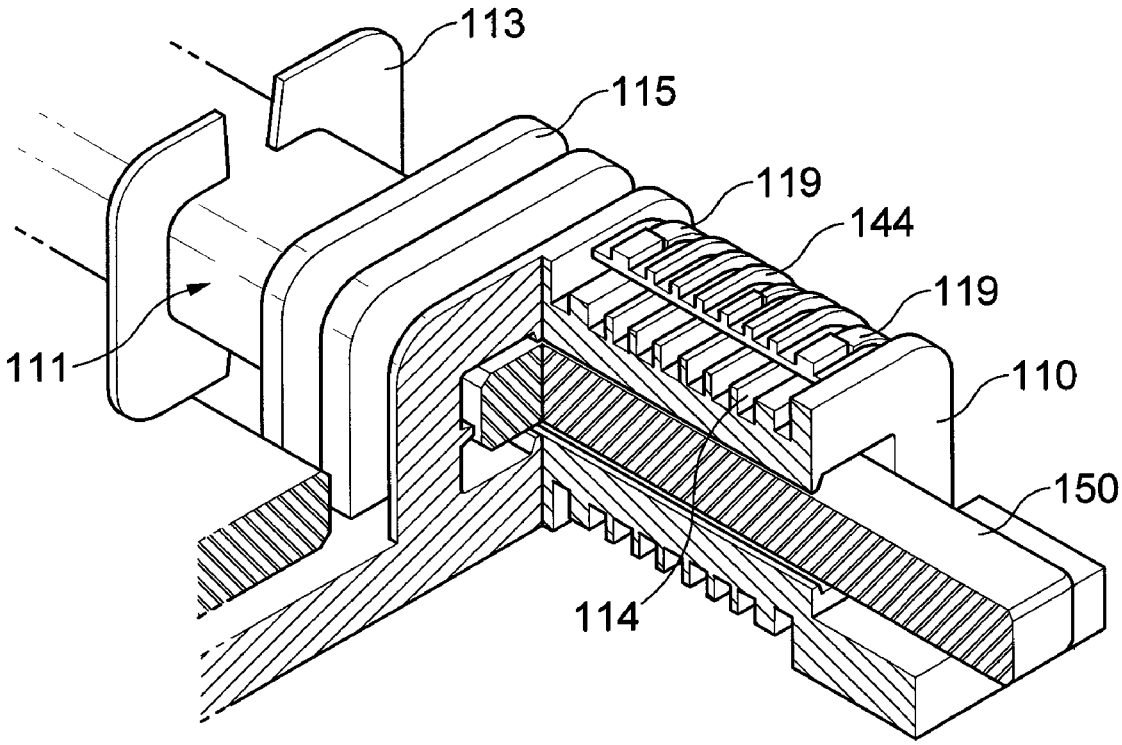

TRANSFORMER

CROSS-REFERENCE TO RELATED APPLICATIONS

This application claims the benefit of Korean Patent Application No. 10-2009-0016200 filed with the Korea Intellectual Property Office on Feb. 26, 2009, the disclosure of which is incorporated herein by reference.

BACKGROUND OF THE INVENTION

1. Field of the Invention

The present invention relates to a transformer; and, more particularly, to a transformer capable of driving a plurality of lamps with one transformer by increasing the number of outer bobbins wrapping an outer circumferential surface of an inner bobbin wound by a coil and the number of output terminals by winding other coils around the outer bobbins.

2. Description of the Related Art

Generally, with the development of information industries, display devices have also made rapid development. LCDs (Liquid Crystal Displays) among the display devices have been widely used because they can be reduced in weight, thickness, and power consumption. Each of the LCDs includes a backlight unit for generating light and a liquid crystal panel for displaying an image by using the light.

The backlight unit consists of a light source for generating the light, an inverter circuit unit for driving the light source, an optical member for uniformly supplying the light to the liquid crystal panel, and so on. Herein, the inverter circuit unit is provided with a transformer for generating an AC high-voltage to drive the light source after receiving an AC low-voltage.

Meanwhile, the display devices gradually increase in size, but internal circuits and parts employed for the display devices have been developed in such a manner as to be increasingly miniaturized. Furthermore, due to intensifying price competition for the display devices, an effort to reduce the number of parts and a unit cost continues to be made.

However, a general transformer includes one or two output terminals for one transformer. Herein, the output terminals output driving power by being electrically connected to one lamp, wherein in the case where as the display device increase in size, the number of lamps needs to increase, there is no alternative but to increase the number of transformers according to the number of lamps, which results in a rise of the cost of the display device employing the transformer and in addition, increases the volume occupied by the transformer in the display device.

SUMMARY OF THE INVENTION

The present invention has been proposed in order to overcome the above-described problems and it is, therefore, an object of the present invention to provide a transformer capable of driving a plurality of lamps with one transformer by increasing the number of output terminals for one transformer.

In accordance with one aspect of the present invention to achieve the object, there is provided a transformer including: an inner bobbin including a primary winding unit receiving an AC voltage and first secondary winding units positioned on at least one side of the primary winding unit; outer bobbins including second secondary winding units coupled to wrap outer circumferential surfaces of the first secondary winding units; a primary coil wound around the primary winding unit;

first secondary coils wound around the first secondary winding units; second secondary coils wound around the second secondary winding units; and cores inserted through a body of the inner bobbin.

Herein, the transformer further includes output terminals separately connected to both end portions of the first and second secondary coils and arranged at one side of the inner bobbin; and input terminals separately connected to both end portions of the primary coil and arranged at the other side of the inner bobbin.

Further, the output terminals are provided in 2n, wherein n is the number of the first and second secondary winding units as an integer.

Further, the primary winding unit is positioned at a center of the inner bobbin and the first secondary winding units are positioned at both sides of the primary winding unit, respectively.

Further, the transformer includes at least one additional outer bobbin wrapping an outer circumferential surface of the outer bobbin and including an additional secondary winding unit; and an additional secondary coil wound around the additional secondary winding unit.

Further, the outer bobbin includes an insertion hole passing through a body to insert the first secondary winding unit of the inner bobbin.

Further, the outer bobbin includes a first sub-outer bobbin wrapping one end of the first secondary winding unit; and a second sub-outer bobbin which is coupled with the first sub-outer bobbin and wraps the other end of the first secondary winding unit.

Further, the first and second sub-outer bobbins include protrusion lines to be fixed to the first secondary winding unit of the inner bobbin and the inner bobbin includes groove lines for inserting and fixing the protrusion lines.

Further, the first and second sub-outer bobbins include hook units and coupling grooves coupled with the hook units, respectively.

Further, the outer bobbin includes a plurality of sub-outer bobbins coupled with an outer circumferential surface of the first secondary winding unit of the inner bobbin while being spaced apart from each other at predetermined intervals.

Further, each of the sub-outer bobbins includes coupling slots and the first secondary winding unit of the inner bobbin includes coupling protrusions coupled with the coupling slots.

Further, the outer bobbin and the first secondary winding unit of the inner bobbin are coupled with each other by an adhesive member.

Further, the outer bobbin is made of insulating resin.

Further, the transformer includes a plurality of slits positioned on the first and second secondary winding units, respectively.

Further, the outer bobbin is made of insulating resin and the second secondary winding unit of the outer bobbin includes a plurality of slits positioned at equal intervals.

In accordance with another aspect of the present invention to achieve the object, there is provided a transformer including: an inner bobbin including a primary winding unit receiving an AC voltage and two first secondary winding units; outer bobbins including second secondary winding units coupled to wrap outer circumferential surfaces of the first secondary winding units; a primary coil wound around the primary winding unit; first secondary coils wound around the first secondary winding units; second secondary coils wound around the second secondary winding units; cores inserted through a body of the inner bobbin; output terminals separately connected to both end portions of the first and second secondary coils and arranged at one side of the inner bobbin in 2n (n is the number of the first and second secondary winding units as an integer); and input terminals separately connected to both end portions of the primary coil and arranged at the other side of the inner bobbin.

Herein, the primary winding unit is positioned at a center of the inner bobbin and the first secondary winding units are positioned at both sides of the primary winding unit, respectively.

Further, the transformer includes at least one additional outer bobbin wrapping an outer circumferential surface of the outer bobbin and including an additional secondary winding unit; and an additional secondary coil wound around the additional secondary winding unit.

Further, the outer bobbin includes an insertion hole passing through a body to insert the first secondary winding unit of the inner bobbin.

Further, the outer bobbin includes a first sub-outer bobbin wrapping one end of the first secondary winding unit; and a second sub-outer bobbin which is coupled with the first sub-outer bobbin and wraps the other end of the first secondary winding unit.

Further, the first and second sub-outer bobbins include protrusion lines to be fixed to the first secondary winding units of the inner bobbin and the inner bobbin includes groove lines for inserting and fixing the protrusion lines.

Further, the first and second sub-outer bobbins include hook units and coupling grooves coupled with the hook units, respectively.

Further, the outer bobbin includes a plurality of sub-outer bobbins coupled with an outer circumferential surface of the first secondary winding unit of the inner bobbin while being spaced apart from each other at predetermined intervals.

Further, each of the sub-outer bobbins includes coupling slots and the first secondary winding unit of the inner bobbin includes coupling protrusions coupled with the coupling slots.

Further, the outer bobbin and the first secondary winding unit of the inner bobbin are coupled with each other by an adhesive member.

Further, the outer bobbin is made of insulating resin.

Further, the transformer includes a plurality of slits positioned on the first and second secondary winding units, respectively.

Further, the outer bobbin is made of insulating resin and the second secondary winding unit of the outer bobbin includes a plurality of slits arranged at equal intervals.

In accordance with still another aspect of the present invention to achieve the object, there is provided a transformer including: an inner bobbin including a primary winding unit receiving an AC voltage and first secondary winding units respectively positioned at both sides of the primary winding unit; outer bobbins which include second secondary winding units coupled to wrap outer circumferential surfaces of the first secondary winding units and provided with a plurality of slits spaced apart from each other at equal intervals, and are formed by injection-molding insulating resin; a primary coil wound around the primary winding unit; first secondary coils wound around the first secondary winding units; second secondary coils wound between the slits of the second secondary winding units; cores inserted through a body of the inner bobbin; output terminals separately connected to both end portions of the first and second secondary coils and connected to lamps by being arranged at one side of the inner bobbin; and input terminals separately connected to both end portions of the primary coil and arranged at the other side of the inner bobbin.

Herein, the insulating resin is at least any one selected from a group consisting of PPS (PolyPhenylene Sulfide), LCP (Liquid Crystal Polyester), PBT (PolyButylene Terephthalate), PET (PolyEthylene Terephthalate) and phenol resin.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is an exploded perspective view showing a transformer in accordance with a first embodiment of the present invention;

FIG. 2 is a plane-view showing the transformer shown in FIG. 1;

FIG. 3 is a cross-sectional view taken along the line I-I' shown in FIG. 2;

FIG. 4 is an exploded perspective view illustrating a portion of the transformer in accordance with the first embodiment of the present invention;

FIG. 5 is a cross-sectional perspective view illustrating a portion of the transformer in accordance with the first embodiment of the present invention;

FIG. 6 is an exploded perspective view illustrating a portion of a transformer in accordance with a second embodiment of the present invention;

FIG. 7 is an exploded perspective view illustrating a transformer in accordance with a third embodiment of the present invention;

FIG. 8 is a plane-view showing the transformer shown in FIG. 7;

FIG. 9 is an exploded perspective view illustrating a portion of the transformer in accordance with the third embodiment of the present invention; and FIG. 10 is a cross-sectional perspective view illustrating a portion of the transformer in accordance with the third embodiment of the present invention.

DETAILED DESCRIPTION OF THE PREFERABLE EMBODIMENTS

Hereinafter, embodiments of the present invention relating to a transformer will be described in detail with reference to the accompanying drawings. The following embodiments are provided as examples to fully convey the spirit of the invention to those skilled in the art. Therefore, the present invention should not be construed as limited to the embodiments set forth herein and may be embodied in different forms. And, in the drawings, the size and the thickness of an apparatus may be exaggerated for clarity. Like reference numerals refer to the like elements throughout.

FIGS. 1 to 5 are views illustrating a transformer in accordance with a first embodiment of the present invention.

FIG. 1 is an exploded perspective view showing a transformer in accordance with a first embodiment of the present invention.

FIG. 2 is a plane-view showing the transformer shown in FIG. 1.

FIG. 3 is a cross-sectional view taken along the line □-□' shown in FIG. 2.

Referring to FIGS. 1 to 3, the transformer 100 in accordance with the present embodiment includes an inner bobbin 110, a primary coil 160, first secondary coils 170, outer bobbins 140, second secondary coils 180, and cores 150.

Specifically, the inner bobbin 110 includes a primary winding unit 111 and first secondary winding units 112 positioned on at least one side of the primary winding unit 111. For example, the primary winding unit 111 may be positioned at a central part of the inner bobbin 110. Further, the first primary winding units 112 may be positioned at both sides of the primary winding unit 111, respectively.

The primary coil 160 may be wound around an outer circumferential surface of the primary winding unit 111. At this time, in order to uniformly distribute the primary coil 160, the inner bobbin 110 further includes a partition 113 positioned at a central portion of the primary winding unit 111.

The first secondary coils 170 are wound around outer circumferential surfaces of the first secondary winding units 112. At this time, in order to uniformly distribute the first secondary coils 170 at predetermined intervals, the inner bobbin 110 may further include a plurality of first slits 114 which are arranged on the first secondary winding units 112.

The inner bobbin 110 has predetermined separation spaces between the primary winding unit 111 and the first secondary winding units 112 and separators 115 may be further positioned in the separation spaces. With the separators 115, it is possible to minimize voltage influence between the primary coil 160 and the secondary coils 170 and 180 which are wound around the primary winding unit 111 and the first and second secondary winding units 112 and 142, respectively.

The positions and the shapes of the primary winding unit 111 and the first secondary winding units 112 are not limited to the embodiment of the present invention.

A body of the inner bobbin 110 is provided with a through hole 116 penetrating in a longitudinal direction. At this time, the cores 150 may be inserted into the through hole 116. The cores may be provided in a pair. Herein, each of the pair of cores 150 may be inserted into the through hole 116 formed at both ends of the inner bobbin 110 to face each other.

Each of the cores 150 may be formed in an 'E' shape, a 'U' shape, and a 'I' shape. Further, the cores 150 may be formed of Mn—Zn ferrite with high permeability, low loss, high saturation magnetic flux density, stability, and low production cost, compared to other materials. However, the shape or the material of the cores is not limited to the present embodiment.

In addition, although not shown in the drawings, the transformer may further include core caps for receiving the cores 150. Herein, the core caps can secure insulation distances between the cores 150 and terminal units 120 and 130, particularly, an output terminal unit 120 or between the cores 150 and the secondary coils 170 and 180 by receiving the cores 150, thereby preventing corona discharge.

Each of the outer bobbins 140 includes a second secondary winding unit 142 wrapping an outer circumferential surface of the first secondary winding unit 112. That is, the outer bobbin 140 includes an insertion hole passing through a body thereof and the first secondary winding unit 112 of the inner bobbin 110 is inserted into the insertion hole. Herein, an assembly structure of the outer bobbin 140 will be described in detail later.

The outer bobbins 140 can be easily manufactured by injection molding. The outer bobbins 140 may be made of insulating resin. Further, the outer bobbins 140 may be made of material with high heat-resistance and high voltage-resistance. Herein, as for material of the outer bobbins 140, PPS (PolyPhenylene Sulfide), LCP (Liquid Crystal Polyester), PBT (PolyButylene Terephthalate), PET (PolyEthylene Terephthalate), phenol resin, and so on may be exemplified.

Each of the second secondary coils 180 is wound around an outer circumferential surface of the second secondary winding unit 142. At this time, since the first primary coil 170 is positioned between the first secondary winding unit 112 and the second secondary winding unit 142 and the second secondary coil 180 is wound around the outer circumferential surface of the second secondary winding unit 142, the first secondary coil 170 and the second secondary coil 180 may be stacked. Herein, since the outer bobbin 140 is made of insulating resin with high heat-resistance and high voltage-resistance, the stacked first and second secondary coils 170 and 180 can be insulated from each other. Furthermore, the outer bobbin 140 can be prevented from being damaged due to heat applied by a high voltage applied to the stacked first and second secondary coils 170 and 180 and insulation between the first secondary coil 170 and the second secondary coil 180 can be maintained to thereby secure reliability of the transformer.

The second secondary winding unit 142 of the outer bobbin 140 may further include a plurality of second slits 144 in order to uniformly distribute the second secondary coil 180 at predetermined intervals. In addition, since the second slits 144 are integrally formed when performing injection molding of the outer bobbin 140, they have an insulating property. Moreover, since the second secondary coil 180 can be uniformly wound around the second secondary winding unit 142, it is possible to maintain a current balance. In addition, short of the wound second secondary coils 180 can be prevented, thereby preventing functional damage of a product.

Meanwhile, the transformer 100 includes the terminal units 120 and 130 provided on the inner bobbin 110, i.e. an input terminal unit 130 and an output terminal unit 120. Herein, the input terminal unit 130 supplies AC power to the primary coil 160. The input terminal unit 130 is connected to pins a which are connected to end portions of the primary coil 160 and includes contact pins b which are in contact with an outside, i.e. a printed circuit board. Further, the input terminal unit 130 may include a first terminal 131 connected to one end of the primary coil 160 and a second terminal 132 connected to the other end of the primary coil 160.

Further, the outer terminal unit 120 is electrically connected to an external device, i.e. a lamp. The output terminal unit 120 supplies the lamp with output power which is set according to a winding ratio between the secondary coils 170 and 180 and the primary coil 160. The output terminal unit 120 is electrically connected to output pins c around which end portions of the secondary coils 170 and 180 are wound and includes output contact pins d which are in electrical contact with the outside, e.g., the printed circuit board. Herein, the output contact pins d may be formed in a shape bending downward but not limited thereto. The output contact pins d are formed in a direction parallel to the output pins c, i.e. a direction parallel to support plates 117 which will be described below.

Herein, the output terminal unit 120 includes 2n output terminals. Herein, n is the number of the first and second secondary winding units 112 and 142 and may be an integer. In other words, both ends of each of the secondary coils 170 and 180 wound around the secondary winding units 112 and 142 are connected to two different output terminals. For example, one end of the first secondary coil 170 wound around the first secondary winding unit 112 is connected to a first output terminal 121 and the other end of the first secondary coil 170 is connected to a second output terminal 122. Further, the output terminal unit 120 includes a third output terminal 123 connected to one end of the second secondary coil 180 wound around the second secondary winding unit 142 and a fourth output terminals 124 connected to the other end of the second secondary coil 180. Therefore, in the case where the transformer 100 includes two secondary winding units, i.e. the first and second secondary winding unit 112 and 142, it may include four output terminals 121 to 124.

At this time, in the transformer in accordance with the embodiment of the present invention, in the case where the first and second secondary winding units 112 and 142 are formed at both sides while interposing the primary winding unit 111, the transformer 100 can have four secondary winding units to thereby include 8 output terminals 121 to 128. Therefore, since the transformer 100 can drive at least 8 lamps or 4 'U'-shaped lamps, the number and the volume of the transformers employed for a display device can be reduced.

At this time, although the transformer 100 in accordance with the present embodiment has been explained for the case that it includes the outer bobbins 140 and the second secondary coils 180, it may further include at least one additional outer bobbin having an additional secondary winding unit wrapping the outer circumferential surface of the second secondary coil wound around the outer bobbin 140 and an additional secondary coil wound around the additional secondary winding unit in order to increase the number of the output terminals 120. As a result, the transformer 100 can include twelve or more output terminals.

In addition, the transformer 100 in accordance with the present embodiment may further include the support plates 117 which are positioned at a lower part of the body of the inner bobbin 110. Herein, the support plates 117 may be integrated with the inner bobbin 110. The support plates 117 uniformly support the body of the inner bobbin 110 so that the inner bobbin 110 can be stably mounted on the printed circuit board.

The input terminal unit 130 and the output terminal unit 120 may be provided at end portions of the support plates 117. Herein, the input terminal unit 130 and the output terminal unit 120 may be positioned at both end portions of the support plates 117, respectively. In other words, the input terminal unit 130 and the output terminal unit 120 may be positioned in opposite directions while interposing the inner bobbin 110. At this time, all of the output terminals may be positioned in the same direction. Further, all of the input terminals may be positioned in the same direction. Therefore, the transformer 100 can overcome an insulating problem between a high-voltage output side and a return wire and a noise problem by preventing generation of the return wire across the high-voltage output side, i.e., the secondary coils 170 and 180 wound around the secondary winding units 112 and 142.

The transformer in accordance with the present embodiment can increase the number of the output terminals for one transformer to at least 8 compared to the prior art, thereby securing price competitiveness for the display device employing the transformer.

Further, the transformer in accordance with the present embodiment can be reduced in volume compared to the prior art by increasing the number of the output terminals for one transformer.

Further, it is possible to facilitate winding work of the stacked coils, i.e. the second secondary coils by employing the outer bobbin.

Further, it is possible to prevent generation of the return wire across the high-voltage output side by positioning the output terminals and the input terminals of the transformer in the opposite directions, thereby solving the insulating problem between the high-voltage output side and the return wire and preventing generation of noise.

Hereinafter, the assembly structure of the outer bobbin will be described in more detail with reference to FIGS. 4 and 5.

FIG. 4 is an exploded perspective view illustrating a portion of the transformer in accordance with the first embodiment of the present invention.

FIG. 5 is a cross-sectional perspective view illustrating a portion of the transformer in accordance with the first embodiment of the present invention.

Referring to FIGS. 4 and 5, the outer bobbin 140 may be fixed to the inner bobbin 110 while having a predetermined separation space.

The outer bobbin 140 may include a first sub-outer bobbin 140*a* and a second sub-outer bobbin 140*b* which face each other. Herein, the first sub-outer bobbin 140*a* is positioned to wrap one end portion of the first secondary winding unit 112 and the second sub-outer bobbin 140*b* is positioned to wrap the other end portion of the first secondary winding unit 112 which is not wrapped by the first sub-outer bobbin 140*a*. That is, since the first and second sub-outer bobbins 140*a* and 140*b* are coupled with the first secondary winding unit 112 of the inner bobbin 110, respectively, the inner bobbin 110 can easily be inserted through the outer bobbin 140. Therefore, the outer bobbin 140 can cover the outer circumferential surface of the first secondary winding unit 112 of the inner bobbin 110 and the first secondary coil 170 and the second secondary coil 180 can be stacked while being insulated from each other by the outer bobbin 140.

Specifically, each of the first and second sub-outer bobbins 140*a* and 140*b* includes protrusion lines 145. Further, the inner bobbin 110 may include groove lines 118 corresponding to the protrusion lines 145. At this time, the protrusion lines 145 are positioned at both ends of each of the first and second sub-outer bobbins 140*a* and 140*b*. Further, the groove lines 118 may be positioned at both ends of the inner bobbin 110.

Herein, as the protrusion lines 145 are slidingly inserted into the groove lines 118, the first and second sub-outer bobbins 140*a* and 140*b* can be fixed to the inner bobbin 110 while wrapping the first secondary winding unit 112 of the inner bobbin 110.

Accordingly, since the outer bobbin 140 includes the protrusion lines 145 and the inner bobbin 110 includes the groove lines 118 for inserting the protrusion lines, the outer bobbin 140 can be easily assembled to the inner bobbin 110.

Further, it is possible to facilitate winding work of the stacked secondary coils, i.e., the second secondary coils 180 by including the outer bobbin 140.

Hereinafter, a transformer in accordance with a second embodiment of the present invention will be described with reference to FIG. 6. The transformer of the second embodiment of the present invention has the same configuration as that of the transformer in accordance with the first embodiment as described above except for a coupling unit. Therefore, a repeated description thereof will be omitted and like reference numerals refer to the like elements throughout.

FIG. 6 is an exploded perspective view illustrating a portion of a transformer in accordance with a second embodiment of the present invention.

Referring to FIG. 6, the transformer in accordance with the present embodiment includes an inner bobbin 110 including a primary winding unit 111 and first secondary winding units 112 positioned on at least one side of the primary winding unit 111, outer bobbins 140 including second secondary winding units 142 wrapping outer circumferential surfaces of the first secondary winding units 112, a primary coil 160 wound around the primary winding unit 111, first secondary coils (see '170' of FIG. 3) wound around the first secondary winding units 112, second secondary coils (see '180 of FIG. 3)

wound around the second secondary winding units 142, and cores (see '150' of FIG. 1) inserted through a body of the inner bobbin 110.

Each of the outer bobbins 140 includes first and second sub-outer bobbins 140*a* and 140*b* facing each other. At this time, the outer bobbin 140 includes a coupling unit for coupling and fixing the first and second sub-outer bobbins 140*a* and 140*b* to each other. For instance, the first sub-outer bobbin 140*a* includes hook units 146 by which it is coupled with the second sub-outer bobbin 140*b*. The hook units 146 may be positioned at end portions of protrusion lines 145 of the first sub-outer bobbin 140*a*. Further, although not shown in the drawing, the second sub-outer bobbin 140*b* includes coupling grooves which are coupled with the hook units 146 by being positioned to correspond to the hook units 146. At this time, the coupling grooves may be positioned at end portions of the protrusion lines 145 of the second sub-outer bobbin 140*b*.

Therefore, since the outer bobbin of the present embodiment includes the first and second sub-outer bobbins divided into at least two and the first and second sub-outer bobbins include the coupling units, i.e., the hook units and the coupling grooves, respectively, it is possible to enhance a coupling property between the first and second sub-outer bobbins.

Hereinafter, a transformer in accordance with a third embodiment of the present invention will be described with reference to FIGS. 7 to 10. The transformer of the third embodiment of the present invention has the same configuration as that of the transformer in accordance with the second embodiment as described above except for an outer bobbin. Therefore, a repeated description thereof will be omitted and like reference numerals refer to the like elements.

FIG. 7 is an exploded perspective view illustrating a transformer in accordance with a third embodiment of the present invention.

FIG. 8 is a plane-view showing the transformer shown in FIG. 7

Referring to FIGS. 7 and 8, the transformer in accordance with the present embodiment includes an inner bobbin 110 including a primary winding unit 111 and first secondary winding units 112 positioned on at least one side of the primary winding unit 111, outer bobbins 240 including second secondary winding units 142 wrapping outer circumferential surfaces of the first secondary winding units 112, a primary coil 160 see '160' of FIG. 3) wound around the primary winding unit 111, first secondary coils (see '170' of FIG. 3) wound around the first secondary winding units 112, second secondary coils (see '180 of FIG. 3) wound around the second secondary winding units 142, and cores 150 inserted through a body of the inner bobbin 110.

The outer bobbins 240 are fixed to the inner bobbin 110. Herein, coupling protrusions 119 are positioned on the first secondary winding units 112 of the inner bobbin 110. Meanwhile, the outer bobbin 240 includes coupling slots 241 into which the coupling protrusions 119 are inserted. At this time, the outer bobbin 240 can be inserted and fixed into the first secondary winding unit 112 of the inner bobbin 110 by inserting the coupling protrusions 119 of the inner bobbin 110 into the coupling slots 241 of the outer bobbin 240.

Hereinafter, an assembly structure of the outer bobbin will be described in more detail with reference to FIGS. 9 and 10.

FIG. 9 is an exploded perspective view illustrating a portion of the transformer in accordance with the third embodiment of the present invention.

FIG. 10 is a cross-sectional perspective view illustrating a portion of the transformer in accordance with the third embodiment of the present invention.

Referring to FIGS. 9 and 10, the outer bobbin 240 may include a plurality of sub-outer bobbins which are coupled with the outer circumferential surface of the first secondary winding unit 112 of the inner bobbin 110 while being spaced apart at predetermined intervals. Herein, the inner bobbin 110 may be formed in several shapes such as a polygon, a circle, and an oval. For example, in the case where the inner bobbin 110 is formed in a rectangular shape, the outer bobbin 240 may include first, second, third, and fourth sub-outer bobbins 240*a* to 240*d* which are coupled to each corner of the inner bobbin 110.

Each of the sub-outer bobbins, i.e. the first to fourth sub-outer bobbins 240*a* to 240*d* includes coupling slots 241. Herein, the coupling slots 241 may be positioned at both end portions of each of the first to fourth sub-outer bobbins 240*a* to 240*b*. In addition, the coupling slots 241 may be positioned at central portions of the first to fourth sub-outer bobbins 240*a* to 240*d*. Herein, the first to fourth sub-outer bobbins 240*a* to 240*d* may not be coupled with each other. That is, the first to fourth sub outer-bobbins 240*a* to 240*d* may be positioned to wrap only corners without wrapping the entire outer circumferential surface of the inner bobbin 110.

Meanwhile, the inner bobbin 110 includes coupling protrusions 119 corresponding to the coupling slots 241. At this time, the coupling protrusions 119 are coupled with the coupling slots 241 to thereby couple the first to fourth sub-outer bobbins 240*a* to 240*d* with the outer circumferential surface of the inner bobbin 110.

Although in the embodiments of the present invention, the assembly of the outer bobbin and the inner bobbin are performed by using a coupling structure, it is not limited to this. For example, as for the assembly of the outer bobbin and the inner bobbin, the outer bobbin may be coupled while wrapping the first secondary winding unit of the inner bobbin by including an adhesive member between the outer bobbin and the inner bobbin.

As described above, the transformer in accordance with the embodiments of the present invention can increase the number of the output terminals for one transformer by including the stacked inner bobbin and the outer bobbins, thereby securing the price competitiveness for the display device employing the transformer and reducing the volume of the transformer.

Further, the transformer can be manufactured through a simple assembly process by further including the coupling structures for coupling the outer bobbins and the inner bobbin.

Further, it is possible to facilitate the winding work of the stacked coils by employing the outer bobbin.

Further, since the insulating slits are provided on the outer bobbins at predetermined intervals to thereby uniformly wind the coils, it is possible to maintain the current balance and prevent the short of the wound coils, thereby securing the reliability of the transformer.

Further, since the output terminals and the input terminals of the transformer are positioned in the opposite directions, the return wire across the high-voltage output side is not generated, thereby overcoming the insulating problem between the high-voltage output side and the return wire and preventing the generation of noise due to the return wire.

As described above, although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

What is claimed is:

1. A transformer comprising:

an inner bobbin including a primary winding unit and first secondary winding units positioned on at least one side of the primary winding unit;

outer bobbins including second secondary winding units coupled to wrap outer circumferential surfaces of the first secondary winding units;

a primary coil wound around the primary winding unit;

first secondary coils wound around the first secondary winding units;

second secondary coils wound around the second secondary winding units; and cores inserted through a body of the inner bobbin, wherein one of the first secondary winding units has a groove, and a corresponding one of the outer bobbins comprises a protrusion that is slidably received by the groove of the one of the first secondary winding units, wherein the corresponding one of the outer bobbins includes a plurality of sub-outer bobbins coupled with an outer circumferential surface of the one of the first secondary winding units, the sub-outer bobbins are spaced apart from each other at predetermined intervals, and wherein the sub-outer bobbins include coupling slots, and the one of the first secondary winding units includes coupling protrusions coupled with the coupling slots.

2. A transformer comprising:

an inner bobbin including a primary winding unit and first secondary winding units positioned on at least one side of the primary winding unit;

outer bobbins including second secondary winding units coupled to wrap outer circumferential surfaces of the first secondary winding units;

a primary coil wound around the primary winding unit;

first secondary coils wound around the first secondary winding units;

second secondary coils wound around the second secondary winding units; and cores inserted through a body of the inner bobbin, wherein one of the outer bobbins includes a plurality of sub-outer bobbins coupled with an outer circumferential surface of a corresponding one of the first secondary winding units, the sub-outer bobbins are spaced apart from each other by predetermined intervals, and wherein the sub-outer bobbins include coupling slots, and the corresponding one of the first secondary winding units includes coupling protrusions coupled with the coupling slots.

* * * * *